US011637364B2

(12) United States Patent
Kim et al.

(10) Patent No.: US 11,637,364 B2
(45) Date of Patent: Apr. 25, 2023

(54) RING-SHAPED ANTENNA AND EAR MODULE COMPRISING SAME

(71) Applicant: AMOTECH CO., LTD., Incheon (KR)

(72) Inventors: Beom Jin Kim, Bucheon-si (KR); Jong Ho Park, Namwon-si (KR)

(73) Assignee: AMOTECH CO., LTD., Incheon (KR)

( * ) Notice: Subject to any disclaimer, the term of this patent is extended or adjusted under 35 U.S.C. 154(b) by 315 days.

(21) Appl. No.: 16/638,411

(22) PCT Filed: Jul. 13, 2018

(86) PCT No.: PCT/KR2018/007988
§ 371 (c)(1),
(2) Date: Feb. 11, 2020

(87) PCT Pub. No.: WO2019/035561
PCT Pub. Date: Feb. 21, 2019

(65) Prior Publication Data

US 2020/0335856 A1 Oct. 22, 2020

(30) Foreign Application Priority Data

Aug. 18, 2017 (KR) ..... 10-2017-0104795

(51) Int. Cl.
*H01Q 1/24* (2006.01)
*H01Q 1/27* (2006.01)
(Continued)

(52) U.S. Cl.
CPC ..... *H01Q 1/273* (2013.01); *H01Q 7/06* (2013.01); *H04R 1/1091* (2013.01); *H04R 2420/07* (2013.01)

(58) Field of Classification Search
CPC ..... H01Q 7/08; H01Q 7/06; H01Q 1/243; H01Q 1/38; H01Q 19/00; H01Q 1/36;
(Continued)

(56) References Cited

U.S. PATENT DOCUMENTS 6,313,802 B1 * 11/2001 Petersson ..... H01Q 15/04 343/753
6,501,437 B1 * 12/2002 Gyorko ..... H01Q 1/362 343/895
(Continued)

FOREIGN PATENT DOCUMENTS

JP 2002-16419 A 1/2002
JP 2008-263369 A 10/2008
(Continued)

*Primary Examiner* — Linh V Nguyen
(74) *Attorney, Agent, or Firm* — CL Intellectual LLC

(57) ABSTRACT

Disclosed are: a ring-shaped antenna which is formed in the form of a ring mounted between the housing of an ear module and the outer circumference of a coin-shaped battery and communicates with an antenna, mounted on another ear module, via NFMI; and a wireless earphone comprising the ring-shaped antenna. The disclosed ring-shaped antenna comprises: a first terminal sheet and a second terminal sheet, each extending from one side of a base sheet and having a terminal formed thereon; a plurality of front radiation patterns disposed apart from one another on the front surface of the base sheet; and a plurality of rear radiation patterns disposed apart from one another on the rear surface of the base sheet, wherein the plurality of front radiation patterns and the plurality of rear radiation patterns are connected through via-holes and thereby form an antenna pattern wound in the vertical direction of the base sheet.

6 Claims, 14 Drawing Sheets

(51) Int. Cl.
*H01Q 7/06* (2006.01)
*H04R 1/10* (2006.01)

(58) Field of Classification Search
CPC ..... H01Q 1/40; H01Q 21/00; H01Q 21/24; H01Q 7/00; H01Q 1/2225; H01Q 1/24
USPC ..... 343/718, 700 ms, 732, 759, 895
See application file for complete search history.

(56) References Cited

U.S. PATENT DOCUMENTS 6,859,174 B2 * 2/2005 Kane ..... H01Q 19/005 343/846
7,315,290 B2 * 1/2008 Harada ..... H01Q 7/00 343/866
7,443,992 B2 * 10/2008 Fideler ..... B33Y 80/00 381/328
7,742,614 B2 * 6/2010 Christensen ..... H04R 25/602 320/108
9,167,360 B2 * 10/2015 Polinske ..... H04R 25/554
10,257,627 B2 * 4/2019 Christensen ..... H01Q 1/24
10,575,106 B1 * 2/2020 Bergmann ..... H04R 25/505
2003/0025478 A1 * 2/2003 Zink ..... H02J 50/12 320/108
2012/0170781 A1 * 7/2012 Klemenz ..... H04R 25/554 381/323
2014/0035793 A1 * 2/2014 Kato ..... H01Q 7/06 343/867
2014/0176060 A1 * 6/2014 Vorperian ..... H04R 25/55 320/108
2014/0307904 A1 * 10/2014 Polinske ..... H04R 25/55 381/323
2016/0261046 A1 * 9/2016 Seigenji ..... H01Q 7/06
2018/0241117 A1 * 8/2018 Hirsch ..... H01Q 1/2291
2020/0021127 A1 * 1/2020 Itagaki ..... H01F 38/14

FOREIGN PATENT DOCUMENTS

JP 2014-93675 A 5/2014
JP 2017-50811 A 3/2017
JP 2017-123653 A 7/2017
KR 2007-0071426 A 7/2007
KR 2013-0092708 A 8/2013

* cited by examiner

| Antenna Pattern Interval | Inductance(uH) | Resistance(Ω) | Q value |
|---|---|---|---|
| | @10.579MHz, Network Analyzer | | |
| 0.1 mm | 3.70 | 2.80 | 87.84 |
| 0.05 mm | 3.7 | 4.22 | 58.28 |
| 0 mm | 3.62 | 5.53 | 43.51 |

FIG.11

| Condition | | | Inductance(uH) | Resistance(Ω) | Q value |
|---|---|---|---|---|---|
| Structure | | Measurement Environment | @10.579MHz, Network Analyzer | | |
| Horizontal Directional Winding Structure |  | Alone(Air) | 4.26 | 4.25 | 66.63 |
| | | Battery Insertion | 3.81 | 8.78 | 28.84 |
| Vertical Directional Winding Structure (Present Disclosure) |  | Alone(Air) | 3.81 | 4.62 | 54.82 |
| | | Battery Insertion | 3.66 | 5.68 | 42.83 |

RING-SHAPED ANTENNA AND EAR MODULE COMPRISING SAME

CROSS-REFERENCE TO RELATED APPLICATIONS

This application is a National Stage of International patent application PCT/KR2018/007988, filed on Jul. 13, 2018, which claims priority to foreign Korean patent application No. KR 10-2017-0104795, filed on Aug. 18, 2017, the disclosures of which are incorporated by reference in their entirety.

FIELD OF THE INVENTION

The present disclosure relates to a ring-shaped antenna, and more particularly, to a ring-shaped antenna and a wireless ear module having the same, which perform communication between ear modules in a wireless earphone in which the ear modules worn on both ears, respectively, are configured separately.

BACKGROUND

An earphone is a device that plugs it into his/her ears to allow him/her to personally listen to sounds such as music and video of a sound source player. The earphone is a sound source device worn on a user's ear, and may be classified into a wired earphone and a wireless earphone according to a connection method with the sound source player.

The wireless earphone is composed of a main ear module for receiving and outputting the sound source from the sound source device through Bluetooth communication and a sub ear module for receiving and outputting the sound source from the main ear module. At this time, the main ear module and the sub ear module are worn on the left ear and the right ear, respectively, and are connected through a cable.

Recently, the wireless earphone is configured in such a manner that the main ear module and the sub ear module are separated to deliver the sound source through Bluetooth communication, such as Apple's AirPod and Samsung's Gear Icon X, in order to enhance a user's convenience.

The main ear module is mounted with two antennas for communication with the sound source device and the sub ear module, and the sub ear module is mounted with one antenna for communication with the main ear module.

Since the wireless earphone is formed compactly, a space capable of mounting the antenna is very narrow, and since it is disposed to be spaced from the left and the right with respect to a wearer's head, it should be small and communicate through the human body (that is, the head).

Therefore, a directional solenoid antenna in which a wire has been wound around a sintered body is used for the wireless earphone.

However, there is a problem in that since the directional solenoid antenna has a narrow directional angle, the wearer differently wears the main ear module and the sub ear module, or a communication distance decreases rapidly according to the wearer's physical condition (for example, the shape of the ear).

Further, there is a problem in that the conventional directional solenoid antenna has a lowered sound quality due to a decrease in the communication distance.

SUMMARY OF THE INVENTION

The present disclosure is intended to solve the above conventional problems, and an object of the present disclosure is to provide a ring-shaped antenna and an ear module having the same, which is formed in a ring shape that is mounted between a housing of an ear module and the outer circumference of a coin-shaped battery to communicate with an antenna mounted to the other ear module through Near-field magnetic induction communication (NFMI) or near-field interaural communication.

For achieving the object, a ring-shaped antenna according to a first embodiment of the present disclosure includes a base sheet, a first terminal sheet formed to extend from one side of the base sheet, and formed with a first terminal, a second terminal sheet formed to extend from one side of the base sheet, and formed with a second terminal, a plurality of front radiation patterns disposed to be spaced apart from one another on the front surface of the base sheet, and a plurality of rear radiation patterns disposed to be spaced apart from one another on the rear surface of the base sheet, and the plurality of front radiation patterns and the plurality of rear radiation patterns form an antenna pattern connected through a via hole to be wound in the vertical direction of the base sheet.

The base sheet may be a synthetic resin having flexibility and insulation, or may be one magnetic sheet selected from a ferrite sheet, a polymer sheet, a nano ribbon sheet, and an iron-based sheet.

The first terminal sheet may be formed to be biased in a first short side direction of the base sheet, and the second terminal sheet may be formed to be biased in a second short side direction of the base sheet.

One front radiation pattern of the plurality of front radiation patterns may have one end connected with the first terminal and have the other end connected with the rear radiation pattern, and the other front radiation patterns may have one end connected with the rear radiation patterns and have the other end connected with the other rear radiation patterns. At this time, the plurality of front radiation patterns may be disposed to be spaced apart from one another, and may be formed in a diagonal shape having the inclination with the short side of the base sheet.

One rear radiation pattern of the plurality of rear radiation patterns may have one end connected with the second terminal and have the other end connected with the rear radiation pattern, and the other rear radiation patterns may have one end connected with the front radiation patterns and have the other end connected with the other front radiation patterns. At this time, the plurality of rear radiation patterns may be disposed to be spaced apart from one another, and may be formed in a straight shape parallel with the short side of the base sheet.

The antenna pattern may be wound alternately around the front surface and the rear surface of the base sheet.

For achieving the object, a ring-shaped antenna according to a second embodiment of the present disclosure includes a base sheet, a radiation wire wound vertically around the base sheet, and a terminal sheet formed with a first terminal and a second terminal contacting both ends of the base sheet, and having both ends of the radiation wire connected, respectively.

The base sheet may be a synthetic resin having flexibility and insulation, or may be one magnetic sheet selected from a ferrite sheet, a polymer sheet, a nano ribbon sheet, and an iron-based sheet.

The radiation wire may wind the front surface and the rear surface of the base sheet, alternately, and portions wound around the same surface may be spaced apart from one another. At this time, the radiation wire may be wound alternately around the long sides of the base sheet.

For achieving the object, an ear module according to an embodiment of the present disclosure includes a housing, a coin-shaped battery accommodated in the housing, and a ring-shaped antenna disposed between the outer circumference of the coin-shaped battery and the housing. At this time, the ear module according to the embodiment of the present disclosure may further include a circuit board accommodated in the ring-shaped antenna, and disposed on the upper portion of the coin-shaped battery, and a terminal sheet of the ring-shaped antenna may be connected to the circuit board.

The ring-shaped antenna may include a base sheet, a first terminal sheet formed to extend from one side of the base sheet, and formed with a first terminal, a second terminal sheet formed to extend from one side of the base sheet, and formed with a second terminal, a plurality of front radiation patterns disposed to be spaced apart from one another on the front surface of the base sheet, and a plurality of rear radiation patterns disposed to be spaced apart from one another on the rear surface of the base sheet, and the plurality of front radiation patterns and the plurality of rear radiation patterns may form an antenna pattern connected through a via holes to be wound in the vertical direction of the base sheet.

The antenna module may include a base sheet, a radiation wire wound vertically around the base sheet, and a terminal sheet formed with a first terminal and a second terminal contacting both ends of the base sheet, and having both ends of the radiation wire connected, respectively. At this time, the ring-shaped antenna may have both short sides spaced and opened.

According to the present disclosure, the ring-shaped antenna may be formed in a ring shape that is mounted between the housing of the ear module and the outer circumference of the coin-shaped battery to communicate with the antenna mounted to the other ear module through Near-field magnetic induction communication (NFMI) or near-field interaural communication, thereby increasing the area of the radiation pattern compared to the conventional antenna winding the radiation pattern around the sintered body to maximize the Quality Factor (Q) and the antenna performance.

Further, the ring-shaped antenna may be formed in a ring shape that is mounted between the housing of the ear module and the outer circumference of the coin-shaped battery to communicate with the antenna mounted in the other ear module through the NFMI, thereby minimizing the influence of the electromagnetic wave on the human body by using the 10 MHz band that is a relatively low frequency compared to Bluetooth of the 2.4 GHz band.

Further, the ring-shaped antenna may be formed in a ring shape that is mounted between the housing of the ear module and the outer circumference of the coin-shaped battery, thereby increasing the communication distance compared to the conventional antenna of the sintered body winding structure, and implementing a certain level (about 25 cm) or more of the communication distance regardless of the directionality.

Further, the ring-shaped antenna may be formed in a ring shape that is mounted between the housing of the ear module and the outer circumference of the coin-shaped battery to communicate with the antenna mounted to the other ear module through the NFMI, thereby providing a certain level or more of the communication distance even when the wearer differently wears the main ear module and the sub ear module, or even under the physical condition (for example, the shape of the ear) of the wearer.

Further, the ring-shaped antenna may be formed in a ring shape that is mounted between the housing of the ear module and the outer circumference of the coin-shaped battery to communicate with the antenna mounted to the other ear module through the NFMI to provide a certain level or more of the communication distance, thereby providing a certain level of the sound quality.

Further, the ring-shaped antenna may form the radiation pattern in the vertical direction of the base sheet, thereby maximizing the Quality Factor (Q) and the antenna performance compared to the ring-shaped antenna having the radiation pattern formed in the horizontal direction of the base sheet when mounted to the ear module. That is, the ring-shaped antenna may have the radiation pattern formed in the vertical direction of the base sheet, thereby maximizing the Quality Factor (Q) and the antenna performance compared to the ring-shaped antenna having the radiation pattern formed in the horizontal direction of the base sheet if the battery, the circuit board, the conductor, and the like are inserted into the ring-shaped antenna when mounted to the ear module.

BRIEF DESCRIPTION OF THE DRAWINGS

FIG. 11 is a diagram for explaining a radiation pattern of the ring-shaped antenna according to an embodiment of the present disclosure.

DETAILED DESCRIPTION

Figure 1:
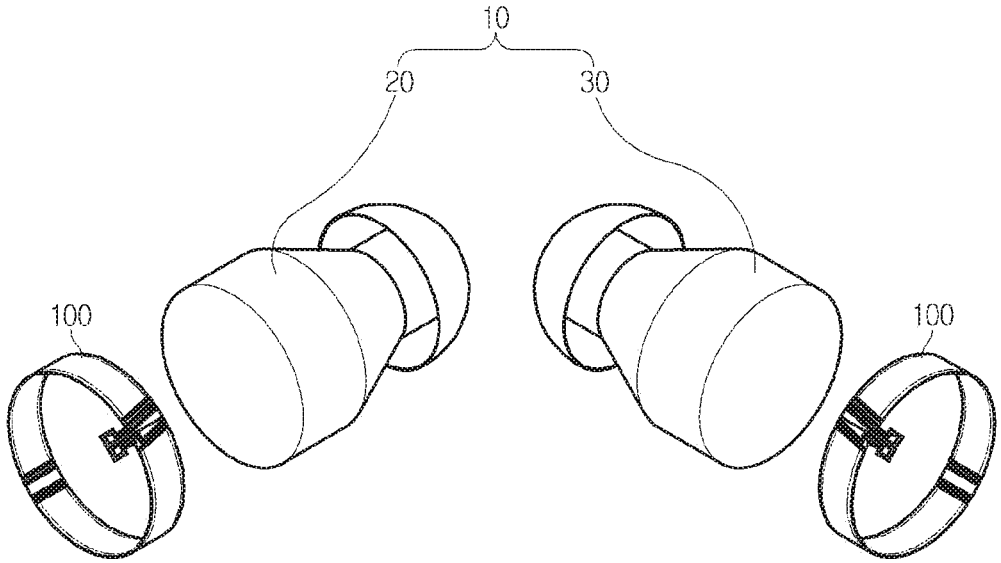
FIG. 1 is a diagram for explaining a ring-shaped antenna according to an embodiment of the present disclosure.

Hereinafter, the most preferred embodiments of the present disclosure will be described with reference to the accompanying drawings in order to specifically describe so that those skilled in the art may easily implement the technical spirit of the present disclosure. First, in adding reference numerals to the components of each drawing, it should be noted that the same components have the same reference numerals as much as possible even if they are displayed in different drawings. Further, in describing the present disclosure, when it is determined that the detailed description of the related well-known configuration or function may obscure the gist of the present disclosure, the detailed description thereof will be omitted.

Referring to FIG. 1, a ring-shaped antenna 100 according to an embodiment of the present disclosure is formed in a ring shape to be mounted to a main ear module 20 and a sub ear module 30 of a wireless earphone 10. Here, the ring-shaped antenna 100 illustrates only a portion of an antenna pattern.

The ring-shaped antenna 100 operates as an antenna for communication between the main ear module 20 and the sub ear module 30. At this time, the ring-shaped antenna 100 operates as a Near-field magnetic induction communication (NFMI) antenna that resonates in a frequency band of about 10 MHz.

In FIG. 1, although it has been described as an example that the ring-shaped antenna 100 is mounted to the main ear module 20 and the sub ear module 30 of the wireless earphone 10, it is not limited thereto and may also be mounted to a hearing aid, a smart watch, or the like that requires near-field communication between devices or modules.

Figure 2:
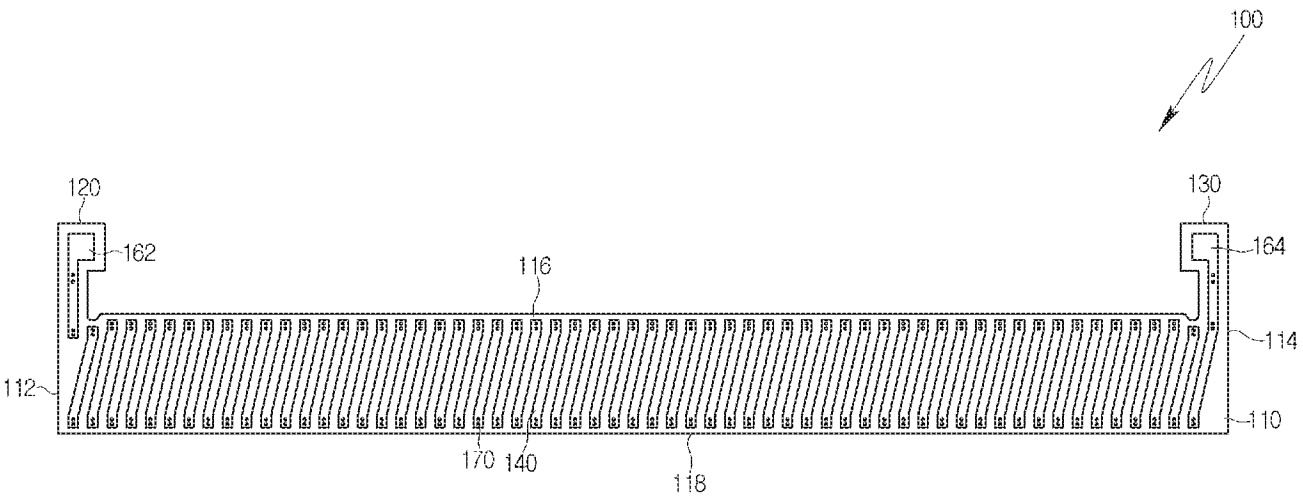
FIGS. 2 to 8 are diagrams for explaining a ring-shaped antenna according to a first embodiment of the present disclosure.
Figure 3:
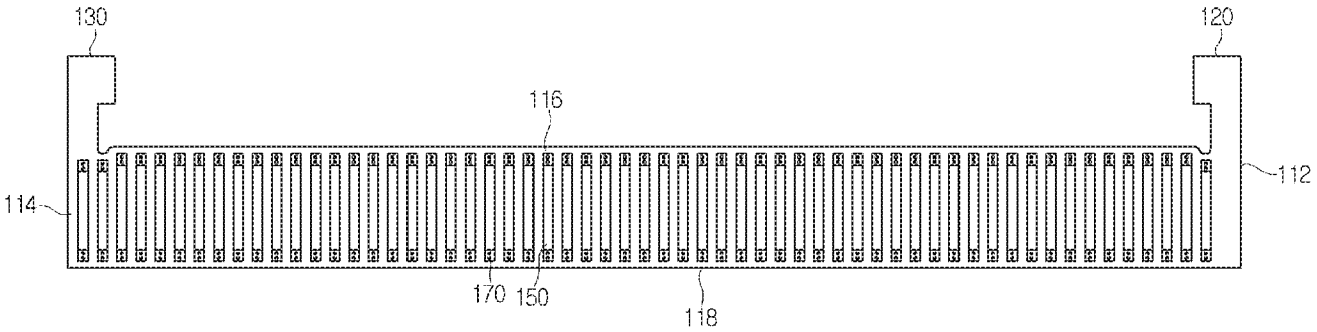

Referring to FIGS. 2 and 3, the ring-shaped antenna 100 according to a first embodiment of the present disclosure includes a base sheet 110, a first terminal sheet 120, a second terminal sheet 130, a plurality of front radiation patterns 140, and a plurality of rear radiation patterns 150.

The base sheet 110 is made of a synthetic resin having flexibility and insulation. That is, since the ring-shaped antenna 100 is formed in a ring shape, the base sheet 110 is made of a material having flexibility and insulation that is easy to process a ring shape. The base sheet 110 may also be a flexible printed circuit board (FPCB) having a magnetic sheet interposed between sheets of a synthetic resin material. At this time, the base sheet 110 may have a rectangular shape having a first short side 112, a second short side 114, a first long side 116, and a second long side 118.

The base sheet 110 may also be made of a magnetic material. The base sheet 110 is, for example, one magnetic sheet among a ferrite sheet, a polymer sheet, a nano ribbon sheet, and an iron-based sheet.

The first terminal sheet 120 is formed to extend from one side of the base sheet 110. That is, the first terminal sheet 120 is formed to extend outward from the first long side 116 or the second long side 118 of the base sheet 110.

The first terminal sheet 120 is formed with a first terminal 162 connected with the front radiation pattern 140 or the rear radiation pattern 150 formed on the base sheet 110. At this time, the first terminal 162 is connected with a circuit board 50 of the wireless earphone 10 when the ring-shaped antenna 100 is mounted. At this time, the first terminal sheet 120 is disposed to be biased in the direction of the first short side 112 of the base sheet 110.

The second terminal sheet 130 is formed to extend from one side of the base sheet 110. That is, the second terminal sheet 130 is formed to extend outward from the first long side 116 or the second long side 118 of the base sheet 110. At this time, the second terminal sheet 130 is disposed to be biased in the direction of the second short side 114 of the base sheet 110.

The second terminal sheet 130 is formed with a second terminal 164 connected with the front radiation pattern 140 or the rear radiation pattern 150 formed on the base sheet 110. At this time, the second terminal 164 is connected with the circuit board 50 of the wireless earphone 10 when the ring-shaped antenna 100 is mounted.

The first terminal sheet 120 and the second terminal sheet 130 may be formed to be spaced apart from each other on the same long side, or may be formed on the long sides different from each other. Here, although it has been described that the first terminal sheet 120 and the second terminal sheet 130 are separated from the base sheet 110 for easily explaining the ring-shaped antenna 100 according to an embodiment of the present disclosure, they are not limited thereto and may also be formed integrally with the base sheet 110.

The plurality of front radiation patterns 140 are disposed on the front surface of the base sheet 110. That is, the plurality of front radiation patterns 140 are disposed to be spaced apart from one another on the front surface of the base sheet 110. The plurality of front radiation patterns 140 may be made of a metal material such as copper, aluminum, or silver. The plurality of front radiation patterns 140 are formed on one surface of the base sheet 110 through processes such as deposition, printing, and plating.

The plurality of front radiation patterns 140 are formed to have an inclination with the first short side 112 or the second short side 114 of the base sheet 110. That is, the plurality of front radiation patterns 140 are formed to have a predetermined inclination with the first short side 112 or the second short side 114. Therefore, the extension line of the front radiation pattern 140 crosses the extension line of the first short side 112 or the second short side 114 outside the base sheet 110.

One of the plurality of front radiation patterns 140 has one end connected with the first terminal 162 or the second terminal 164 through a via hole 170, and has the other end connected with the rear radiation pattern 150 through the via hole 170. The other front radiation patterns 140 have both ends connected with the rear radiation patterns 150 different from one another through the via holes 170, respectively.

For example, if the front radiation pattern 140 is composed of the number of n, the first front radiation pattern 140 to the $(n-1)^{th}$ front radiation pattern 140 disposed to be biased to the first short side 112 of the base sheet 110 have both ends connected to the rear radiation patterns 150 different from one another through the via holes 170, respectively. The $n^{th}$ front radiation pattern 140 disposed to be biased to the second short side 114 of the base sheet 110 has one end connected with the rear radiation pattern 150 through the via hole 170, and has the other end connected with the second terminal 164.

The plurality of rear radiation patterns 150 are disposed on the rear surface of the base sheet 110. That is, the plurality of rear radiation patterns 150 are disposed to be spaced apart from one another on the rear surface of the base sheet 110. The plurality of rear radiation patterns 150 may be made of a metal material such as copper, aluminum, or silver. The plurality of rear radiation patterns 150 are formed on one surface of the base sheet 110 through processes such as deposition, printing, and plating.

The plurality of rear radiation patterns 150 may be formed in parallel with the first short side 112 and the second short side 114 of the base sheet 110. One of the plurality of rear radiation patterns 150 has one end connected with the first terminal 162 or the second terminal 164 through the via hole 170, and has the other end connected with the front radiation pattern 140 through the via hole 170. The other rear radiation patterns 150 have both ends connected with the front radiation patterns 140 different from one another through the via holes 170, respectively.

For example, if the rear radiation pattern 150 is composed of the number of n, the first rear radiation pattern 150 has one end connected with the first terminal 162 through the via hole 170, and has the other end connected with the front radiation pattern 140 through the via hole 170. The second rear radiation pattern 150 to the $n^{th}$ rear radiation pattern 150 have both ends connected with the front radiation patterns 140 different from one another through the via holes 170, respectively.

The plurality of front radiation patterns 140 and the plurality of rear radiation patterns 150 are connected through the via holes 170 to form antenna patterns in the form of vertically winding the base sheet 110. That is, the ring-shaped antenna 100 is deformed from a planar state into a ring shape, and the plurality of front radiation patterns 140 and the plurality of rear radiation patterns 150 form the antenna patterns of a helical structure vertically winding the ring. At this time, the antenna pattern is wound alternately around the front surface and the rear surface of the base sheet 110, or wound around alternately the first long side 116 and the second long side 118 to be wound in the vertical direction of the base sheet 110. Here, the vertical direction refers to a direction that is perpendicular to or has a predetermined inclination with the long sides (that is, the first long side 116 and the second long side 118) of the base sheet 110.

Figure 4:
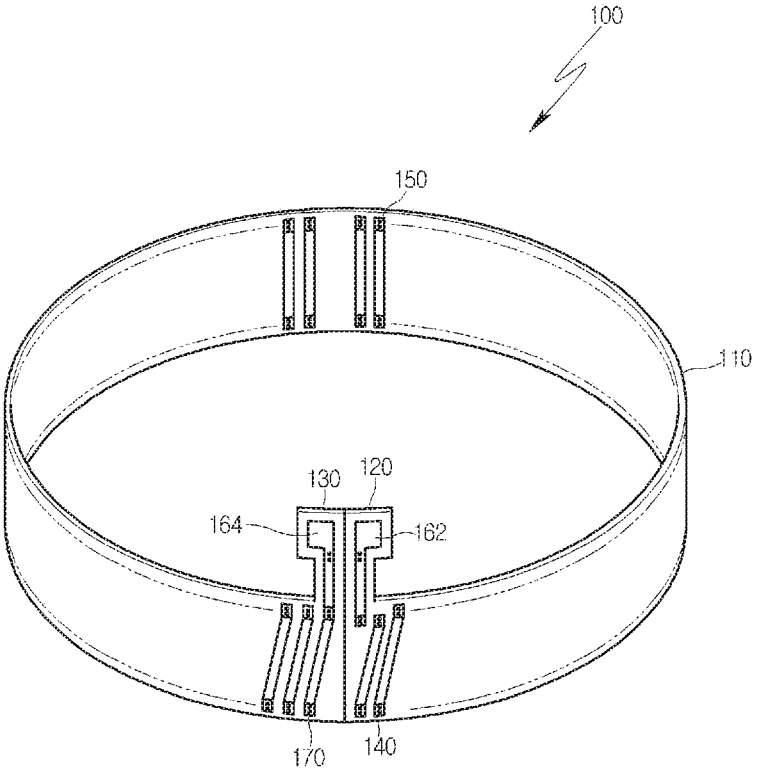

Referring to FIG. 4, the ring-shaped antenna 100 forms a ring shape in which the first short side 112 and the second short side 114 contact each other. That is, the ring-shaped antenna 100 forms a ring shape in which the first short side 112 and the second short side 114 contact each other to be not opened.

Figure 5:
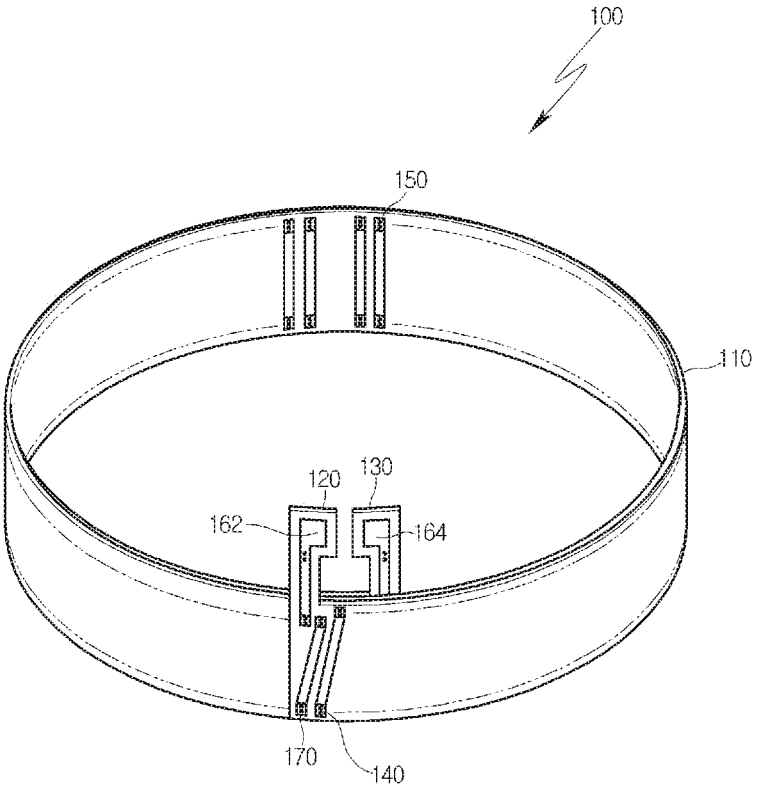

Referring to FIG. 5, the ring-shaped antenna 100 may also form a ring shape in which a portion of the first short side 112 side and a portion of the second short side 114 side overlap to be not opened. That is, the ring-shaped antenna 100 may also form a ring shape in which a portion of the base sheet 110 at the first short side 112 side and a portion of the base sheet 110 at the second short side 114 side overlap to be not opened.

Figure 6:
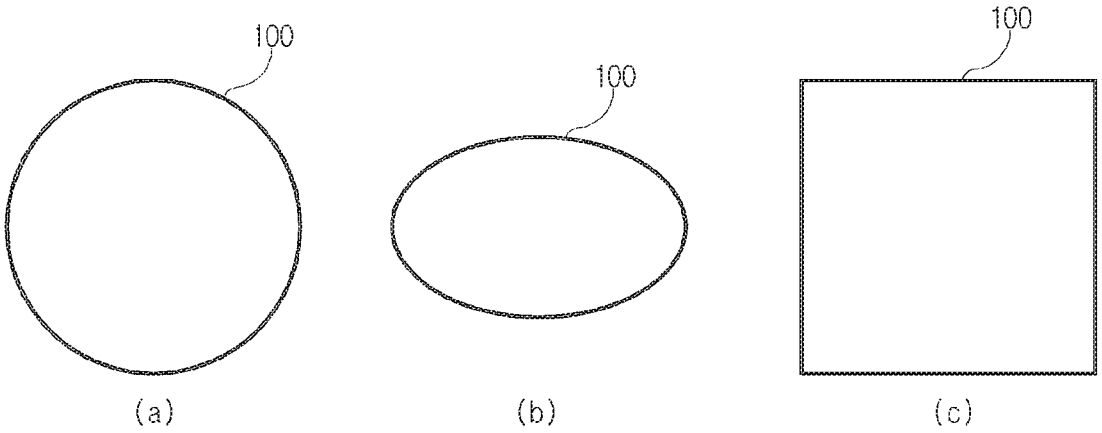

Referring to FIG. 6, the ring-shaped antenna 100 forms a ring shape in which the cross section viewed from the direction of the first long side 116 or the second long side 118 is a circular shape (FIG. 6A) or an elliptical shape (FIG. 6B). At this time, the ring-shaped antenna 100 may also be formed in a ring shape in which the cross section is a polygon such as a triangle, a square, or a hexagon by forming a plurality of bends. For example, the ring-shaped antenna 100 may be formed in a ring shape in which the cross section viewed from the direction of the first long side 116 or the second long side 118 is a square (FIG. 6C) by forming four bends.

Figure 7:
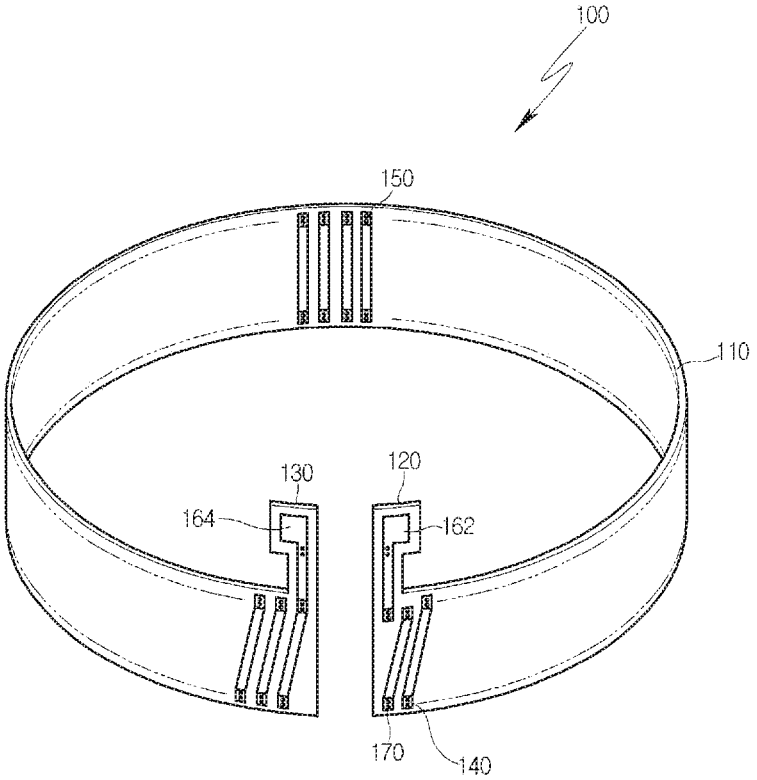

Referring to FIG. 7, the ring-shaped antenna 100 may be formed in a ring shape in which the first short side 112 and the second short side 114 are spaced at a predetermined interval apart from each other to open a portion thereof (for example, a C shape). That is, the ring-shaped antenna 100 may be formed in a ring shape in which as the first short side 112 and the second short side 114 are disposed and separated to face each other, an opening is formed in a separation space between the first short side 112 and the second short side 114.

Here, in FIGS. 4, 5, and 7 described above, the ring-shaped antenna 100 illustrates only a portion of the antenna pattern.

Figure 8:
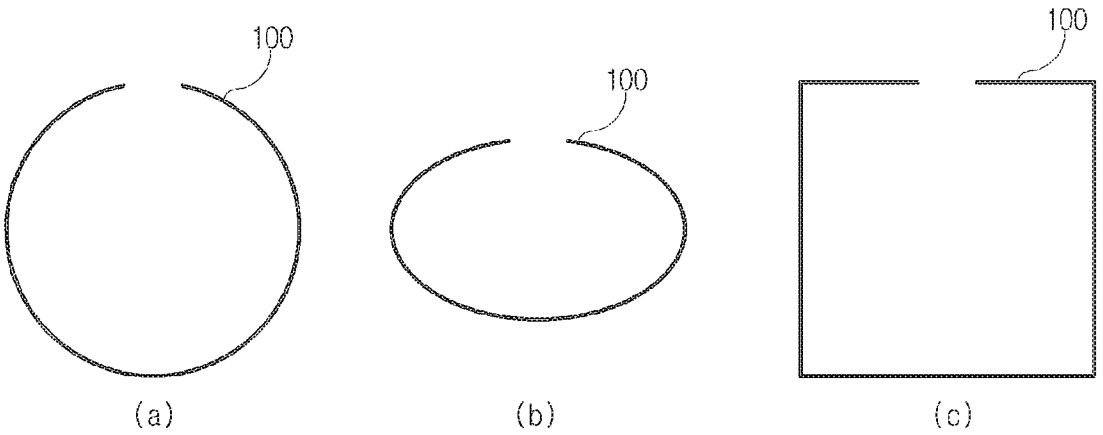

Referring to FIG. 8, the ring-shaped antenna 100 forms a ring shape that is a circular shape (FIG. 8A) or an elliptical shape (FIG. 8B) in which the cross section viewed from the direction of the first long side 116 or the second long side 118 is partially opened. At this time, the ring-shaped antenna 100 may also be formed in a ring shape in which the cross section is a partially opened polygon, such as a triangle, a square, or a hexagon by forming a plurality of bends. For example, the ring-shaped antenna 100 may also be formed in a ring shape in which the cross section viewed from the direction of the first long side 116 or the second long side 118 is a partially opened square (FIG. 8C) by forming four bends.

Figure 9:
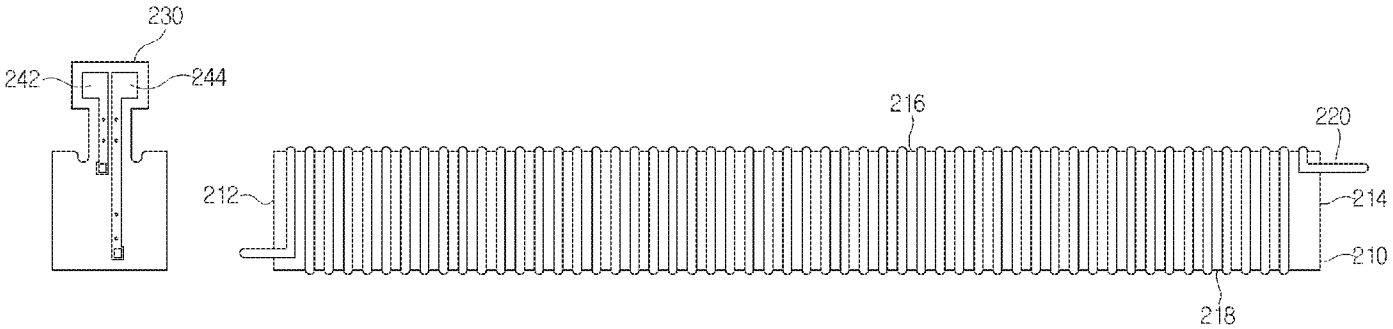
FIGS. 9 and 10 are diagrams for explaining a ring-shaped antenna according to a second embodiment of the present disclosure.
Figure 10:
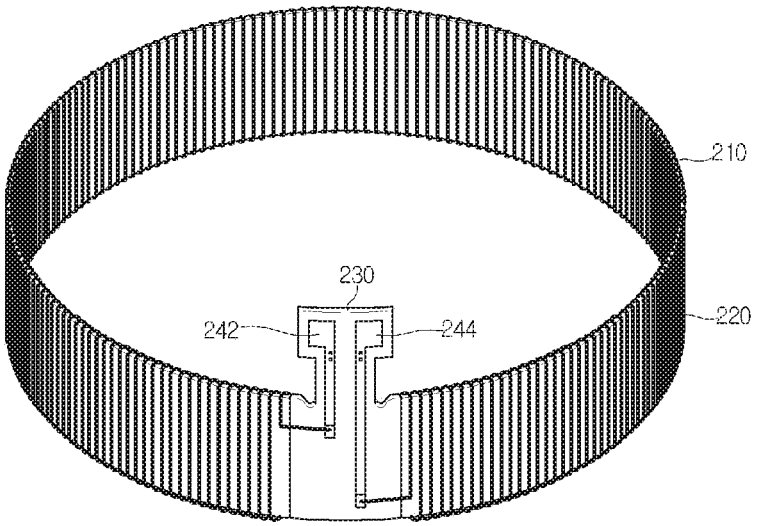

Referring to FIGS. 9 and 10, a ring-shaped antenna 200 according to a second embodiment of the present disclosure includes a base sheet 210, a radiation wire 220, and a terminal sheet 230.

The base sheet 210 is made of a synthetic resin having flexibility and insulation. That is, since the ring-shaped antenna 200 is formed in a ring shape, the base sheet 210 is made of a material having flexibility and insulation that is easy to process a ring shape. The base sheet 210 may also be a flexible printed circuit board (FPCB) having a magnetic sheet interposed between sheets of a synthetic resin material. At this time, the base sheet 210 may be a rectangular shape having a first short side 212, a second short side 214, a first long side 216, and a second long side 218.

The base sheet 210 may also be made of a magnetic material. The base sheet 210 is, for example, one magnetic sheet among a ferrite sheet, a polymer sheet, a nano ribbon sheet, and an iron-based sheet.

The radiation wire 220 is wound around the base sheet 210, and is wound in the vertical direction of the base sheet 210. That is, the radiation wire 220 alternately passes through the first long side 216 and the second long side 218 to be disposed alternately on the front surface and the rear surface of the base sheet 210 to be wound in the vertical direction of the base sheet 210. At this time, the radiation wire 220 is wound in the direction from the second short side 214 to the first short side 212 on the front surface of the base sheet 210, and wound in the direction from the first short side 212 to the second short side 214 on the rear surface of the base sheet 210, for example.

The radiation wire 220 is wound around the plate-shaped base sheet 210, and then connected to the terminal sheet 230 connected to the base sheet 210. At this time, the radiation wire 220 may also be wound around the base sheet after the base sheet 210 and the terminal sheet 230 have been formed in a ring shape.

The radiation wire 220 is disposed so that portions formed on the same surface are spaced apart from one another. That is, when wound around the base sheet 210, the radiation wires 220 wound around the front surface (or the rear surface) of the base sheet 210 are disposed to be spaced at a predetermined interval apart from one another. Here, the radiation wire 220 is, for example, a conductive metal material such as copper (Cu) or silver (Ag).

The terminal sheet 230 is connected with the first short side 212 and the second short side 214 of the base sheet 210. That is, as one end of the terminal sheet 230 and the first short side 212 of the base sheet 210 are connected, the other end of the terminal sheet 230 and the second short side 214 of the base sheet 210 are connected, the terminal sheet 230 and the base sheet 210 are formed in a ring shape, and the radiation wire 220 forms an antenna pattern for winding the ring vertically.

The terminal sheet 230 may be made of a synthetic resin having flexibility and insulation, or may be one magnetic sheet among a ferrite sheet, a polymer sheet, a nano ribbon sheet, and an iron-based sheet. At this time, the terminal sheet 230 may also be formed integrally with the base sheet 210.

The terminal sheet 230 has a first terminal 242 and a second terminal 244 connected with the radiation wire 220 disposed to be spaced apart from each other. That is, the first terminal 242 is formed on one surface of the terminal sheet 230 to be connected with one end of the radiation wire 220 through soldering, and the second terminal 244 is formed to be spaced apart from the first terminal 242 on one surface of the terminal sheet 230 to be connected with the other end of the radiation wire 220 through soldering. At this time, the first terminal 242 and the second terminal 244 may be composed of a pair of terminals disposed on the same surface and the rear surface thereof. Here, the first terminal 242 and the second terminal 244 are connected to a terminal formed on the circuit board 50 of the wireless earphone 10, respectively, when the ring-shaped antenna 200 is mounted.

Referring to FIG. 11, as the interval between the patterns in the antenna patterns (that is, the front radiation pattern 140, the rear radiation pattern 150, and the radiation wire 220) of the ring-shaped antennas 100, 200 is narrow, a resistance value for the use frequency increases, thereby lowering the Quality Factor (Q).

Therefore, the ring-shaped antennas 100, 200 are wound so that the antenna patterns are spaced at a predetermined interval apart from one another. For example, in the case of using the use frequency of about 10.579 MHz, which is the NFMI band, the interval between the patterns of the antenna pattern is preferably about 0.05 mm or more.

Figure 12:
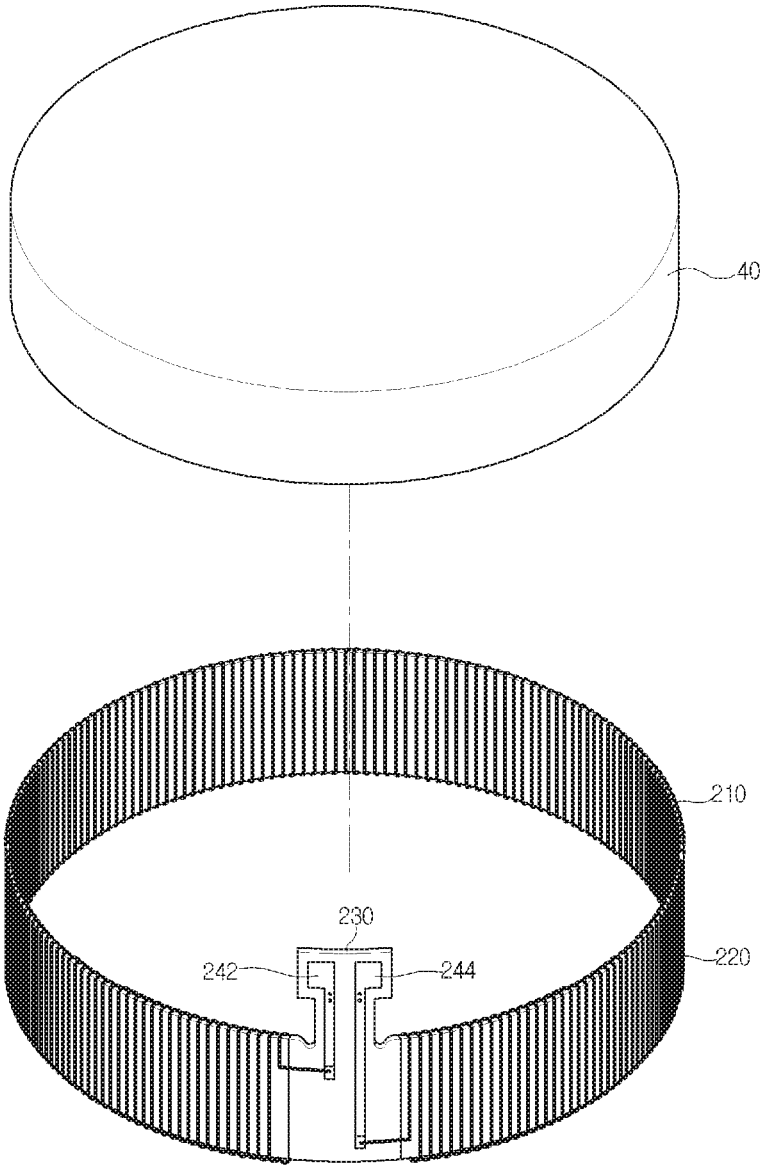
FIGS. 12 to 14 are diagrams for explaining the ring-shaped antenna according to an embodiment of the present disclosure.

Referring to FIG. 12, the ring-shaped antennas 100, 200 are disposed on the outer circumference of the coin-shaped battery 40 mounted to the ear modules (that is, the main ear module 20 and the sub ear module 30). That is, the ring-shaped antennas 100, 200 are disposed to surround the side outer circumference of the coin-shaped battery 40 having the inner circumference accommodated in the ear module. At this time, the ring-shaped antennas 100, 200 may further include a magnetic sheet (not illustrated) disposed on the other surface (that is, the surface facing the side outer circumference of the coin-shaped battery 40). Here, the magnetic sheet is formed of a ferrite sheet, a flexible polymer sheet, or the like.

The ring-shaped antennas 100, 200 may also be disposed between the outer circumference of the coin-shaped battery 40 and the housing of the ear module. That is, the ring-shaped antennas 100, 200 may be disposed so that the inner circumference surrounds the side outer circumference of the coin-shaped battery 40 and the outer circumference is adjacent to the inner wall surface of the housing.

The ring-shaped antennas 100, 200 are connected with the circuit board 50 through the terminal sheet 230. That is, the terminal sheet 230 is bent outward from the ring-shaped antennas 100, 200, and the first terminal 242 and the second terminal 244 formed on the terminal sheet 230 are connected to the circuit board 50 disposed outside the ring-shaped antennas 100, 200. At this time, the first terminal 242 and the second terminal 244 may be electrically connected to the circuit board 50 through soldering, or may be electrically connected to the circuit board 50 through a conductive adhesive agent.

Figure 13:
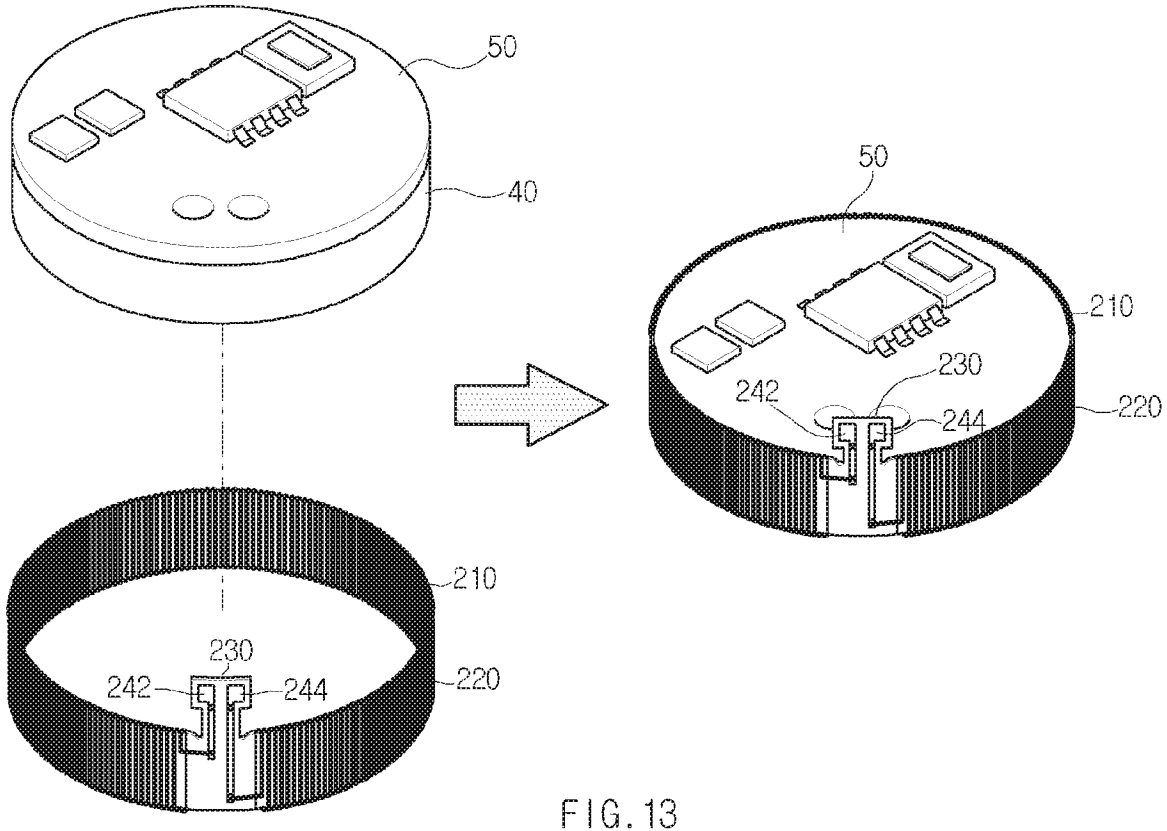

Referring to FIG. 13, the ring-shaped antennas 100, 200 may also be disposed on the outer circumferences of the coin-shaped battery 40 and the circuit board 50 of the ear module. That is, the ring-shaped antennas 100, 200 are disposed so that the inner circumference surrounds the outer circumference of the coin-shaped battery 40 and the outer circumference of the circuit board 50 disposed on one surface of the coin-shaped battery 40.

The ring-shaped antennas 100, 200 are connected with the circuit board 50 through the terminal sheets 120, 130, 230. That is, the terminal sheets 120, 130, 230 are bent inward from the ring-shaped antennas 100, 200, and the first terminals 162, 242 and the second terminals 164, 244 formed on the terminal sheets 120, 130, 230 are connected to the circuit board 50 disposed inside the ring-shaped antennas 100, 200. At this time, the first terminals 162, 242 and the second terminals 164, 244 may be electrically connected to the circuit board 50 through soldering, or may be electrically connected to the circuit board 50 through a conductive adhesive agent.

Figure 14:
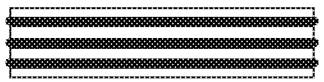
Figure 14:
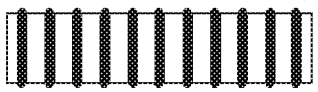

FIG. 14 is data having measured the inductance, resistance, and Quality Factor (Q) of the ring-shaped antennas 100, 200 formed of a horizontal directional winding structure and a vertical directional winding structure.

Referring to FIG. 14, the ring-shaped antennas 100, 200 of the vertical directional winding structure according to an embodiment of the present disclosure form the inductance of about 3.81 uH, the resistance of about 4.62Ω, and the Quality Factor (Q) of about 54.82 when used alone, and form the inductance of about 3.66 uH, the resistance of about 5.68Ω, and the Quality Factor (Q) of about 42.83 if the battery 40 is inserted.

The ring-shaped antenna of the horizontal directional winding structure forms the inductance of about 4.26 uH, the resistance of about 4.25Ω and the Quality Factor (Q) of about 66.63 when used alone, and forms the inductance of about 3.81 uH, the resistance of about 8.78Ω, and the Quality Factor (Q) of about 28.84 if the battery 40 is inserted.

At this time, the ring-shaped antenna of the horizontal directional winding structure has the characteristics of the Quality Factor (Q) higher than that of the ring-shaped antennas 100, 200 of the vertical directional winding structure when used alone, but forms the Quality Factor (Q) of about 28.84 that has been lowered by about 37.79 due to a decrease in the inductance value at the use frequency and an increase in the resistance value if the battery 40, the circuit board 50, and the conductor are inserted.

On the contrary, the ring-shaped antennas 100, 200 of the vertical directional winding structure have the characteristics of the Quality Factor (Q) lower than that of the ring-shaped antenna of the horizontal directional winding structure when used alone, but form the Quality Factor (Q) of about 42.83 that has been lowered by about 11.99 at the use frequency if the circuit board 50 and the conductor are inserted.

This is because if the circuit board 50 and the conductor are inserted, the decrease in the inductance value and the increase in the resistance value of the ring-shaped antennas 100, 200 of the vertical directional winding structure are smaller than those of the ring-shaped antenna of the horizontal directional winding structure, thereby minimizing to lower the Quality Factor (Q).

Therefore, the ring-shaped antennas 100, 200 of the vertical directional winding structure according to an embodiment of the present disclosure may enhance the characteristics of the Quality Factor (Q) compared to the ring-shaped antenna of the horizontal directional winding structure when applied to the ear module.

Although the preferred embodiment according to the present disclosure has been described above, it is understood that changes may be made in various forms, and those skilled in the art may practice various changed examples and modified examples without departing from the claims of the present disclosure.

The invention claimed is:

1. A ring-shaped antenna, comprising:

a rectangular base sheet having a first short side, a second short side, a first long side, and a second long side;

a radiation wire alternately passing through the first long side and the second long side to be wound vertically around the base sheet; and a terminal sheet formed with a first terminal and a second terminal, wherein the base sheet and the terminal sheet are formed in a ring shape, wherein one end of the terminal sheet is connected to the first short side of the base sheet and the other end of the terminal sheet is connected to the second short side of the base sheet, wherein the terminal sheet extends further outward than the first long side of the base sheet, and wherein the first terminal and the second terminal are connected to both ends of the radiation wire respectively.

2. The ring-shaped antenna of claim 1, wherein the base sheet is a synthetic resin having flexibility and insulation.

3. The ring-shaped antenna of claim 1, wherein the base sheet is one magnetic sheet selected from a ferrite sheet, a polymer sheet, a nano ribbon sheet, and an iron-based sheet.

4. The ring-shaped antenna of claim 1, wherein the radiation wire winds the front surface and the rear surface of the base sheet, alternately, and portions wound around the same surface are spaced apart from one another.

5. An ear module, comprising:

a housing;

a coin-shaped battery accommodated in the housing; and a ring-shaped antenna disposed between the outer circumference of the coin-shaped battery and the housing, wherein the ring-shaped antenna comprises a rectangular base sheet having a first short side, a second short side, a first long side, and a second long side;

a radiation wire alternately passing through the first long side and the second long side to be wound vertically around the base sheet; and a terminal sheet formed with a first terminal and a second terminal, wherein the base sheet and the terminal sheet are formed in a ring shape, wherein one end of the terminal sheet is connected to the first short side of the base sheet and the other end of the terminal sheet is connected to the second short side of the base sheet, wherein the terminal sheet extends further outward than the first long side of the base sheet, and wherein the first terminal and the second terminal are connected to both ends of the radiation wire respectively.

6. The ear module of claim 5, further comprising a circuit board accommodated in the ring-shaped antenna, and disposed on the upper portion of the coin-shaped battery, wherein a terminal sheet of the ring-shaped antenna is connected to the circuit board.

* * * * *